US005577722A

United States Patent [19]

Glassberg

[11] Patent Number: 5,577,722

[45] Date of Patent: Nov. 26, 1996

[54] BAT GRIP DEVICE

[76] Inventor: Corey Glassberg, 5 Winmere Pl., Dix Hills, N.Y. 11746

[21] Appl. No.: 499,307

[22] Filed: Jul. 7, 1995

[51] Int. Cl.[6] ..... A63B 59/06

[52] U.S. Cl. ..... 273/26 B; 273/72 R

[58] Field of Search ..... 273/72 R, 72 A, 273/26 B, 67 R, 67 DA, 67 DB, 81.4

[56] References Cited

U.S. PATENT DOCUMENTS 979,266 12/1910 Dean ..... 273/72 R 1,638,454 8/1927 Papin ..... 273/81.4

2,471,610 5/1949 Christensen ..... 273/72 R X 5,011,145 4/1991 Bartkowicz ..... 273/72 R

*Primary Examiner*—William H. Grieb

*Attorney, Agent, or Firm*—Schweitzer Cornman & Gross

[57] ABSTRACT

A bat grip comprises a pair of grip elements each being contoured on its outer surface to accept a hand of the user. The grip elements are individually positionable upon the bat to accommodate differing grip styles and positions.

8 Claims, 3 Drawing Sheets

FIG. 1
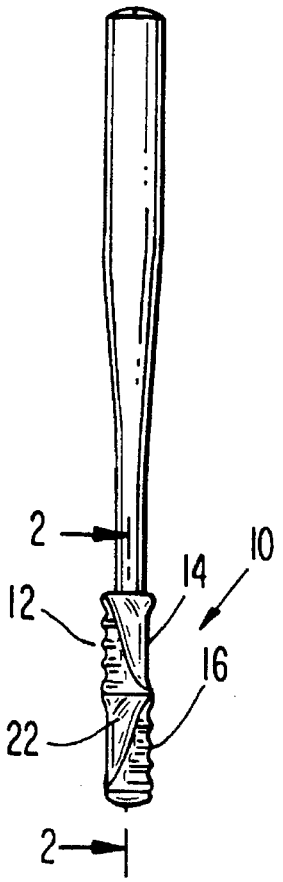
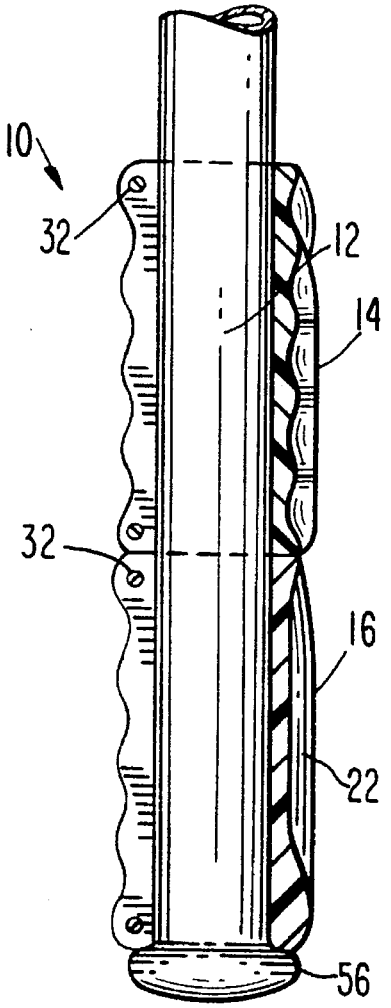
FIG. 2
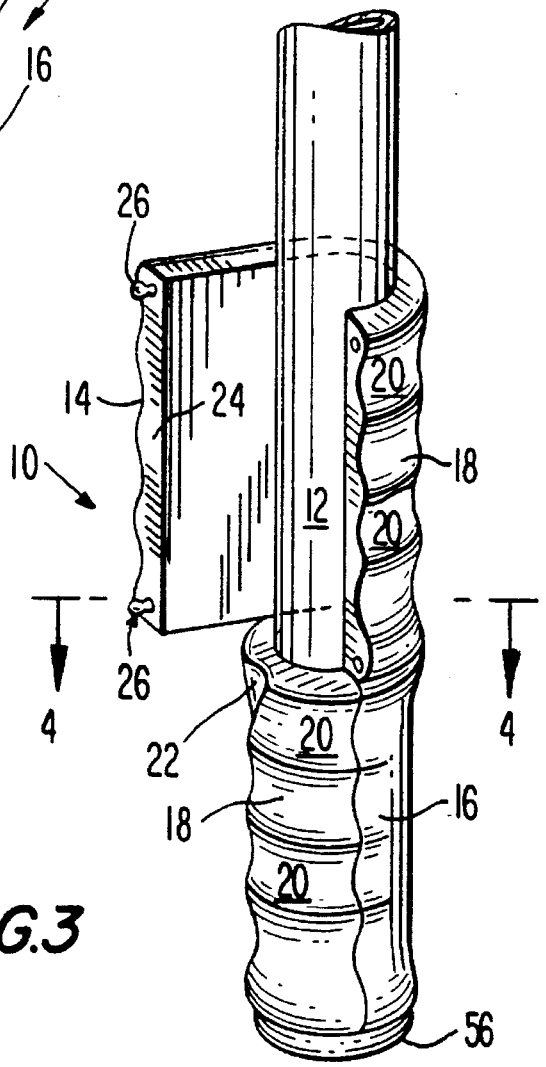
FIG. 3

FIG. 7
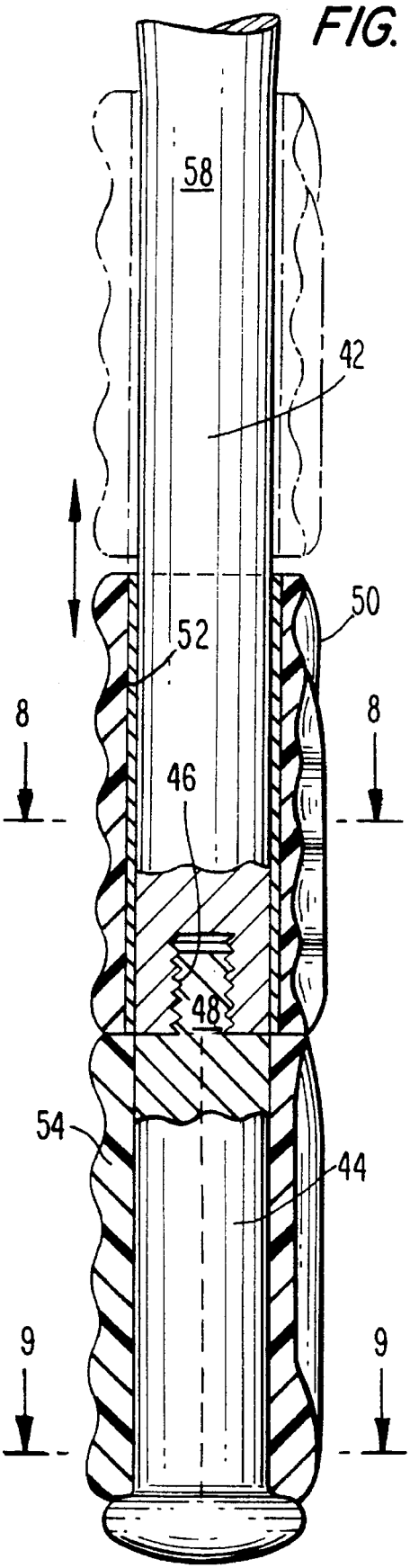
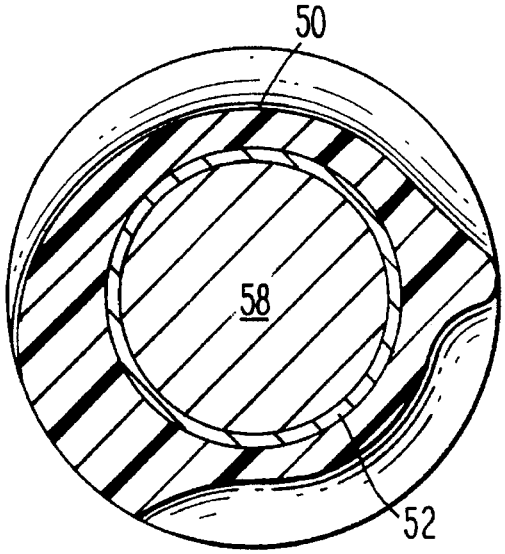
FIG. 8
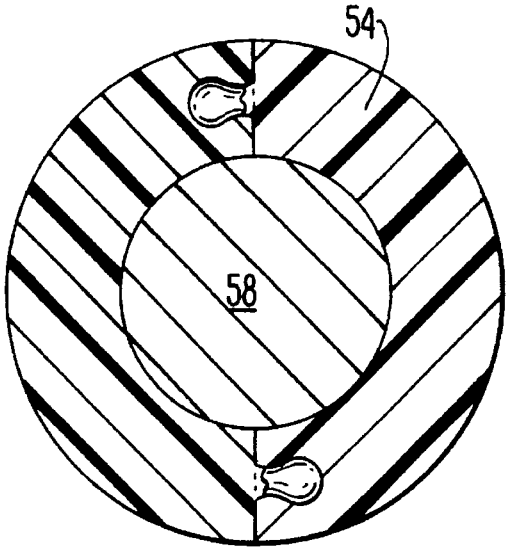
FIG. 9

BAT GRIP DEVICE

The present invention relates to a new and improved device for assisting in the grip of a baseball or softball bat.

BACKGROUND OF THE INVENTION

It is well recognized that the development of batting skills in baseball, softball or stickball relies upon a proper grip of the bat by the batter. Thus, the learning of proper hand orientation upon the bat is an important aspect of the learning process. Because the bat is cylindrical it is often difficult for a beginning batter, and particularly a child, to gain a proper understanding of hand orientation and be able to repeat the same proper orientation each time he or she picks up a bat.

It is accordingly a purpose of the present invention to provide a mechanism which may be affixed to, or fabricated as a part of, a softball or baseball bat which facilitates the proper placement of the hands on the bat to allow the user to both familiarize him or herself with the proper orientation and to further provide a comfortable grip for the user.

In addition, even accomplished batters often find that their grip on a bat is subject to loosening or displacement resulting, for example, from sweat on their palms or the lack of "tack" between their hands and the bat shaft.

It is thus a further purpose of the present invention to provide a bat grip apparatus which allows a batter to obtain a sure and comfortable grip on the bat, and which further assists the batter in maintaining proper hand position thereon, and to improve bat power and control.

BRIEF DESCRIPTION OF THE INVENTION

In accordance with the above and further objects and purposes, a bat grip in accordance with the present invention comprises a pair of resilient sleeve-like elements which are mounted about the handle of the bat. The exterior surface of each of the elements is contoured to receive and thus conform to the fingers of the respective hand to be placed thereon in a bat-gripping orientation. The two grip members may be independently positionable with respect to each other, both along the length of the handle as well as angular orientation about the handle. In one embodiment the grip members are separate, while in a second embodiment the grip members are interconnected to allow for limited relative positioning motion therebetween. In the installed position, the grips provide proper orientation of the hands to be attained, and, when gripped, remain in position to allow the proper grip to be continued through the batting swing.

BRIEF DESCRIPTION OF THE DRAWINGS

A fuller understanding of the present invention will be obtained upon review of the following, detailed description of preferred, but nonetheless illustrative embodiments of the invention, when considered in conjunction with the annexed drawings, wherein:

FIG. 1 is an elevation view of a first embodiment of the invention installed upon a baseball or softball bat;

FIG. 2 is a section view taken along line 2—2 of FIG. 1;

FIG. 3 is a perspective view of the first embodiment, depicting one of the grips in the process of being installed upon the bat, by use of a first form of attachment means;

FIG. 7 is an elevation view in section of a third embodiment of the invention;

FIG. 8 is a section view taken along line 8—8 of FIG. 7; and

FIG. 9 is a section view taken along line 9—9 of FIG. 7, depicting an alternative for the grip members as incorporated into the embodiment of FIG. 7.

DESCRIPTION OF THE INVENTION

Figure 4:
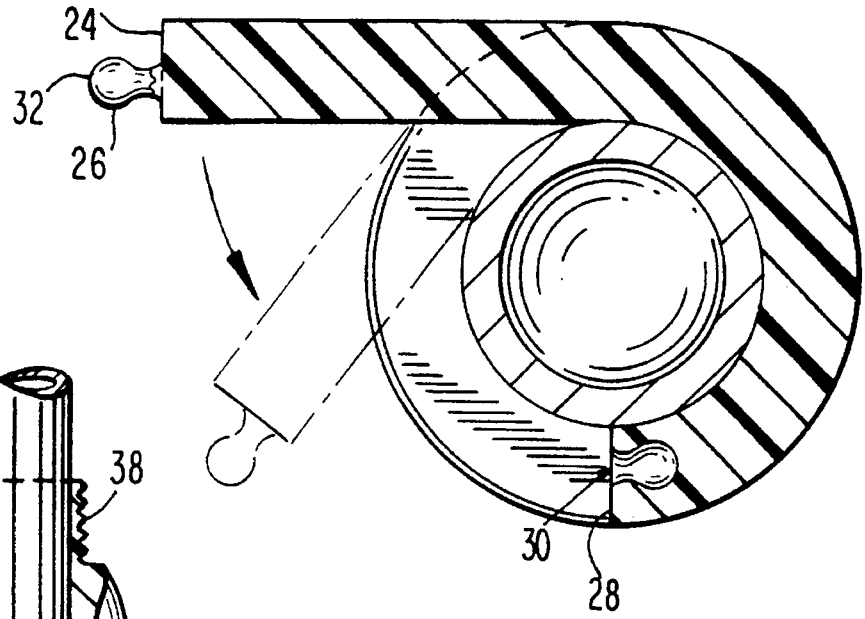
FIG. 4 is a section view taken along line 4—4 of FIG. 3.

Referring initially to FIG. 1, a handgrip 10 of the present invention is designed and adapted to be installed upon the lower, handle portion of a bat 12 as known and utilized for baseball, softball, stickball or the like. The bat may be solid, typically constructed of a strong, resilient wood such as ash, or may be of metal, such as aluminum, in which case the bat is typically hollow. The handgrip 10 comprises first and second individual handgrip members 14 and 16, each of which is adapted to accept one of the hands of the user. As shown in FIGS. 2 and 3, in a first embodiment the first and second grip members 14 and 16 may constitute separately-formed elements which are separately mounted adjacent to each other upon the bat handle. Such a configuration allows each of the grip members to be independently positioned on the bat handle.

Each of the grip members includes, on its outer surface, the hand contours 18, which may include finger portions 20 and a palm and thumb portion 22, allowing the mating of the grip member with the hand holding the grip member and bat. Each of the grip members is preferably formed from a resilient, yet non-slip, material, such as a rubber or plastic composition, molded or otherwise formed with the appropriate outer surface configuration and with a generally smooth interior surface adapted to grip the bat handle. Each grip member may be fabricated in a variety of sizes, to accommodate different size hands as well as different diameter bat handles which the grip members are to encircle.

As further depicted in FIGS. 3 and 4, each of the handgrip members may be formed in a flat orientation, which is subsequently installed on the bat by wrapping around the bat handle. As seen in those Figures, a first end surface 24 of the grip element may include a pair of bulbous protrusions 26, the opposite end surface or edge 28 of the grip element having mating recesses or bores 30. The protrusions may be formed integrally with the handgrip member, or may be of another material, such as metal with a shank (not shown) which is threaded or otherwise embedded in the handgrip. In such a case, the top of the protrusion may be provided with a screwdriver-accepting slot 32, shown in FIG. 2, to allow the shank to be driven into an accepting bore in the first edge of the grip. Because of the flexible nature of the handgrips, the protrusions 26 form a snap fit with the receiving bores 30, retaining the handgrip in the wrapped configuration about the handle. Alternatively, other fastener means may be employed, as may be known in the art. For stickball use, the grip members can be formed in the cylindrical form, to be slid onto the bat, since the end knob 56 is not present.

The handgrip members are preferably dimensioned to provide a somewhat snug fit when wrapped about the bat handle, but should be loose enough to accommodate some measure of rotation and translational movements about and along the bat by the hands when the hands are in loose fit on the grips. The nature of the grips is such, however, that when pressure upon the grip is increased by the user, the inner surface "grabs" the bat handle surface making rotation or other movement more difficult. This effectively affixes the handgrip members in place, maintaining the positioning of the hands on the bat while pressure on the grips the handgrip is maintained. Such increased grip may be accomplished by the nature of the inner surface of the grip, and may be enhanced by the use of auxiliary means, such as a small projection or the like, which engage the bat handle when the grip element is squeezed.

Figure 5:
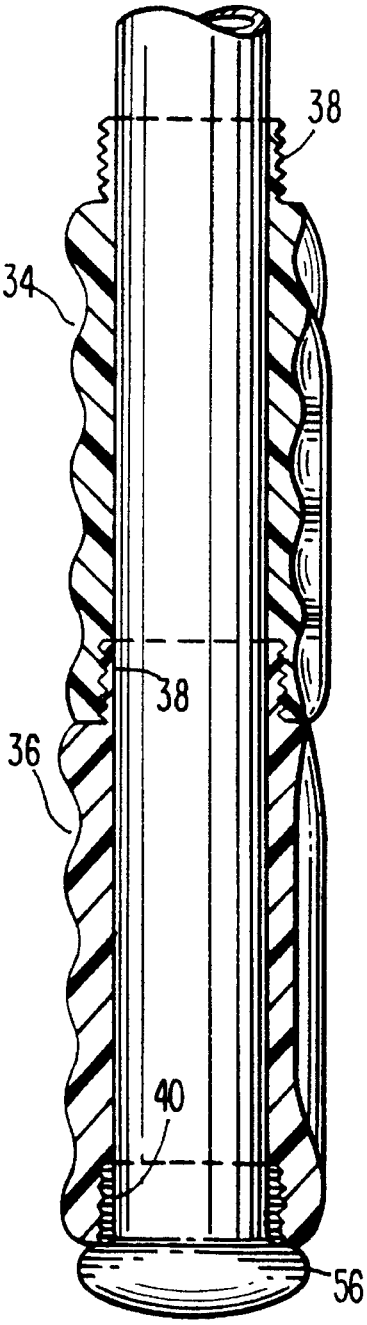
FIG. 5 is an elevation view in section of a second embodiment of the invention.
Figure 6:
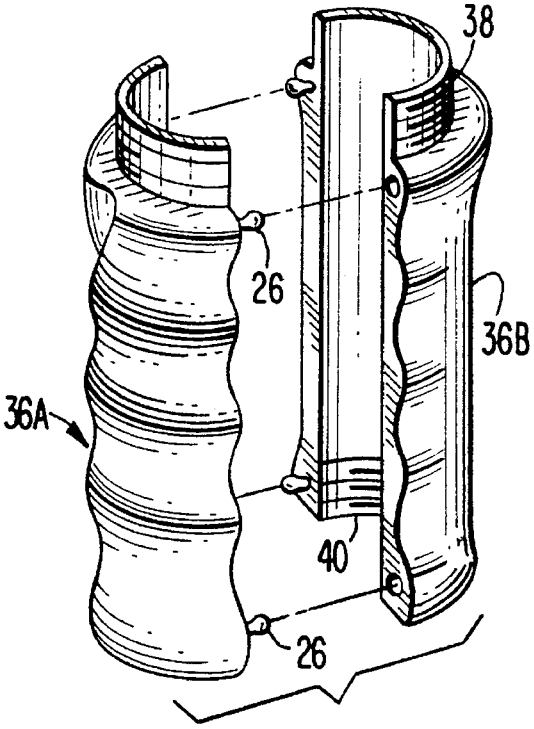
FIG. 6 is a perspective view of the embodiment of FIG. 5, detailing how the grip members are constructed to allow installation on the bat.

A second embodiment of the invention is depicted in FIGS. 5 and 6. As shown therein, the first and second grip members 34, 36 engage each other. As best seen in FIG. 5, the means of engagement may preferably be a threaded collar portion 38 molded as part of the upper end of each of the grip members, with a mating threaded recess 40 being located upon the inner surface of the lower end of each grip. As each of the grip members is contoured for a particular hand, either right or left, the inclusion of engagement means at the top and bottom of each grip member allows the relative positioning of the grips to be reversed for left and right-handed batters. Once again, the diameter of the grip is such that, with little or moderate hand pressure thereon, relative rotation between the grip members can occur. The choice of thread pitch, coupled with the length of the thread and accepting bore, maintain the grips coupled together, yet allow for relative angular positioning of the grips and with multiple rotations along the thread, a degree of vertical spacing therebetween. Once again, with full hand pressure thereon, the handgrips more fully engage with the bat surface, preventing subsequent relative motion while the grip is maintained. Alternatively, the mating thread portions of the grips may be chosen to provide a tight interconnection which will retain its relative position of the grip members when aligned as desired against subsequent hand movement. It is contemplated that the thread pitch employed is to be relatively fine, to allow rotational adjustment between the members to be accomplished with relatively little vertical spacing. The length of the threads, however, can accommodate vertical spacings when desired through multiple rotations.

In this embodiment, as shown in FIG. 6, each of the grip members may advantageously be formed in a two-piece construction, utilizing the protrusion members 26 and the two portions of each grip member being snapped together over the handle of the bat, the two grip members then being screwed together and oriented with respect to each other as appropriate for use.

Alternatively, a further construction for the present invention is shown in FIG. 7, wherein the bat itself is particularly constructed for use in conjunction with the grip members. As shown therein, the bat 58 is formed in two sections, a main section 42, which includes the barrel of the bat and which terminates at its lower end with the upper portion of the bat handle section, and a second section 44, which comprises the lower end of the bat handle. As shown in the Figure, the bat sections may be of solid construction, or alternatively, may be hollow. The two bat sections are connectable together by a thread and bore assembly, the interior lower end of the main section 42 having a threaded bore 46 which accepts a similarly-threaded stud 48 extending upwardly from the top end of the second section 44. The stud may be formed integral with the bat section body, or may comprise a separate element mounted to the bat core.

A first handgrip element 50 is positioned on the main section. It can be of a construction as shown for the previous embodiments, whereby it is wrapped or "snapped" about the bat, or, because the end of the bat is removable, the grip may be cast in the cylindrical configuration, as shown in FIG. 8, whereby it may be simply slid into position on the bat. In either form, an insert sleeve 52 may be provided between the handgrip and the bat. This insert allows a single diameter grip element to be mounted on bats of varying diameter. a series of inserts, of differing inner diameter, and/or wall thickness, can be provided to match the handgrip element to the bat with which it is to be used. The insert may be of plastic, rubber, or other appropriate material, preferably of a material which will transmit the gripping force to the bat to prevent rotation of the grip element when the bat is firmly gripped therethrough. The handgrip (and insert) can be positioned as desired, as shown by the phantom position in the Figure.

The second bat section 44 may have the second grip member 54 bonded to its surface, or may be of conventional construction, the grip element removably mounted thereon, either directly or with an intermediate sleeve. When the grip member is to be mounted upon the bat section, it can be formed in a manner as previously described, or alternatively may be of a two-piece snap-fit construction as shown in FIG. 9. Such a construction may be used for the other embodiment. With the grip members in place on the bat, the bat sections are threaded together, the threads allowing for rotational adjustment of the two sections. Again, the threads may be formed in a manner that rotation therebetween is not smooth, thereby providing a frictional component which will tend to keep the handle sections in relative orientation to each other and thus prevent inadvertent relative rotation of the handle sections when the bat is in use.

I claim:

1. A bat grip, comprising a first grip element having an outer surface conforming to a first hand of the user to be gripped thereby and a second grip element having an outer surface conforming to a second hand of the user to be gripped thereby, said first and second grip elements adapted to be independently positionable upon a bat handle in their relative rotational and axial orientations, each of said grip elements being of a generally cylindrical construction and having an inner surface for releasably rigidly engaging the bat handle when firmly gripped by the user.

2. The bat grip of claim 1, wherein said first and second grip elements include cooperating connector means.

3. The bat grip of claim 1, wherein said first and second grip elements are in the form of a generally sheet-like element including interconnecting means on opposite edges thereof for retaining said grip elements in a cylindrical form about the bat handle.

4. The bat grip of claim 1 further comprising an insert positionable between one of said grip elements and said bat handle.

5. A bat grip apparatus comprising a bat having first and second portions removably engageable with each other, each of said portions including an adjacent portion of a handle section of the bat; first and second grip elements, each having an outer surface conforming to a hand of the user; said first grip element being mounted to said first bat portion and said second grip element being mounted to said second bat portion, and means for adjusting the relative axial and rotational orientation of said grip elements upon said bat portions, said adjusting means comprise mating threaded portions of said first and second bat portions.

6. The bat grip of claim 5 further comprising an insert positionable between one of said grip elements and the respective one of said first and second bat portions.

7. A bat grip, comprising a first grip element having an outer surface conforming to a first hand of the user to be gripped thereby and a second grip element having an outer surface conforming to a second hand of the user to be gripped thereby, said first and second grip elements adapted to be independently positionable upon a bat handle in their relative rotational and axial orientations, said first and second grip elements including cooperating connector means comprising a threaded stem on one of said grip elements and a mating thread on the other of said grip elements.

8. The bat grip of claim 7, wherein each of said grip elements is of a generally cylindrical construction and include an inner surface for releasably engaging the bat handle when firmly gripped by the user.

* * * * *